United States Patent [19]

Artzberger

[11] Patent Number: 5,062,228

[45] Date of Patent: Nov. 5, 1991

[54] COMPACTOR AND BLADE ATTACHMENT FOR LOADER

[75] Inventor: Thomas G. Artzberger, Menomonee Falls, Wis.

[73] Assignee: M-B-W Inc., Slinger, Wis.

[21] Appl. No.: 546,899

[22] Filed: Jul. 2, 1990

[51] Int. Cl.[5] ..... E02F 3/76

[52] U.S. Cl. ..... 37/117.5; 37/DIG. 3; 37/DIG. 18; 404/117

[58] Field of Search ..... 37/117.5, 108 R, DIG. 3, 37/DIG. 18; 404/117, 128, 133; 405/271

[56] References Cited

U.S. PATENT DOCUMENTS

| | | | |
|---|---|---|---|
| 3,963,134 | 6/1976 | Leroux | 37/117.5 X |
| 4,009,529 | 3/1977 | Johnson | 37/117.5 |
| 4,023,288 | 5/1977 | Roe | 37/117.5 |
| 4,100,688 | 7/1978 | Grist | 37/117.5 |
| 4,195,947 | 4/1980 | Lambertz | 404/117 |
| 4,201,493 | 5/1980 | Braun | 404/117 |
| 4,577,995 | 3/1986 | Sadahiro | 404/117 |
| 4,698,926 | 10/1987 | Caplis et al. | 37/117.5 X |
| 4,732,507 | 3/1988 | Artzberger | 404/117 |
| 4,749,305 | 6/1988 | Brown et al. | 404/117 |

*Primary Examiner*—Randolph A. Reese
*Assistant Examiner*—Franco S. DeLiguori
*Attorney, Agent, or Firm*—Andrus, Sceales, Starke & Sawall

[57] ABSTRACT

A compactor and blade attachment for a front-end loader. The attachment comprises a compaction drum that is journalled for rotation on the side plates of the frame. A vibratory mechanism is connected to the drum to vibrate the drum and aid in the compaction. A blade is secured to the frame and is located ahead of the drum in the direction of movement of the loader. A pair of lift arms of the loader are pivoted to the lower end of the frame, while a pair of tilt arms of the loader are pivoted to the upper portion of the frame. By operation of the tilt arms, the frame can be tilted about the pivotal connections of the lift arms to thereby selectively move the blade between a non-operative position above the level of the lower surface of the drum to an operative position beneath the level of the drum where the blade will engage the terrain.

4 Claims, 2 Drawing Sheets

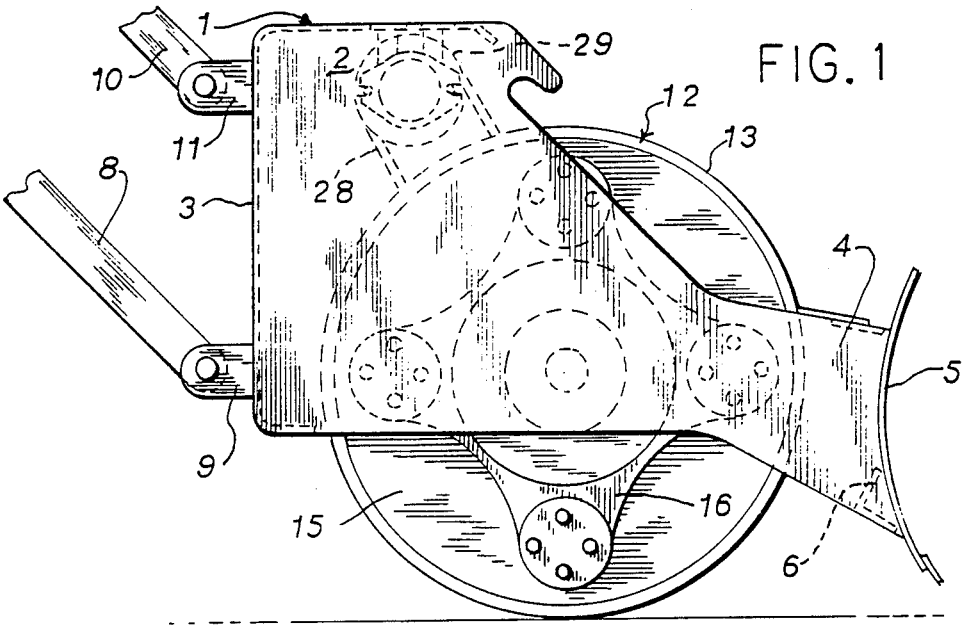
FIG. 1
FIG. 2
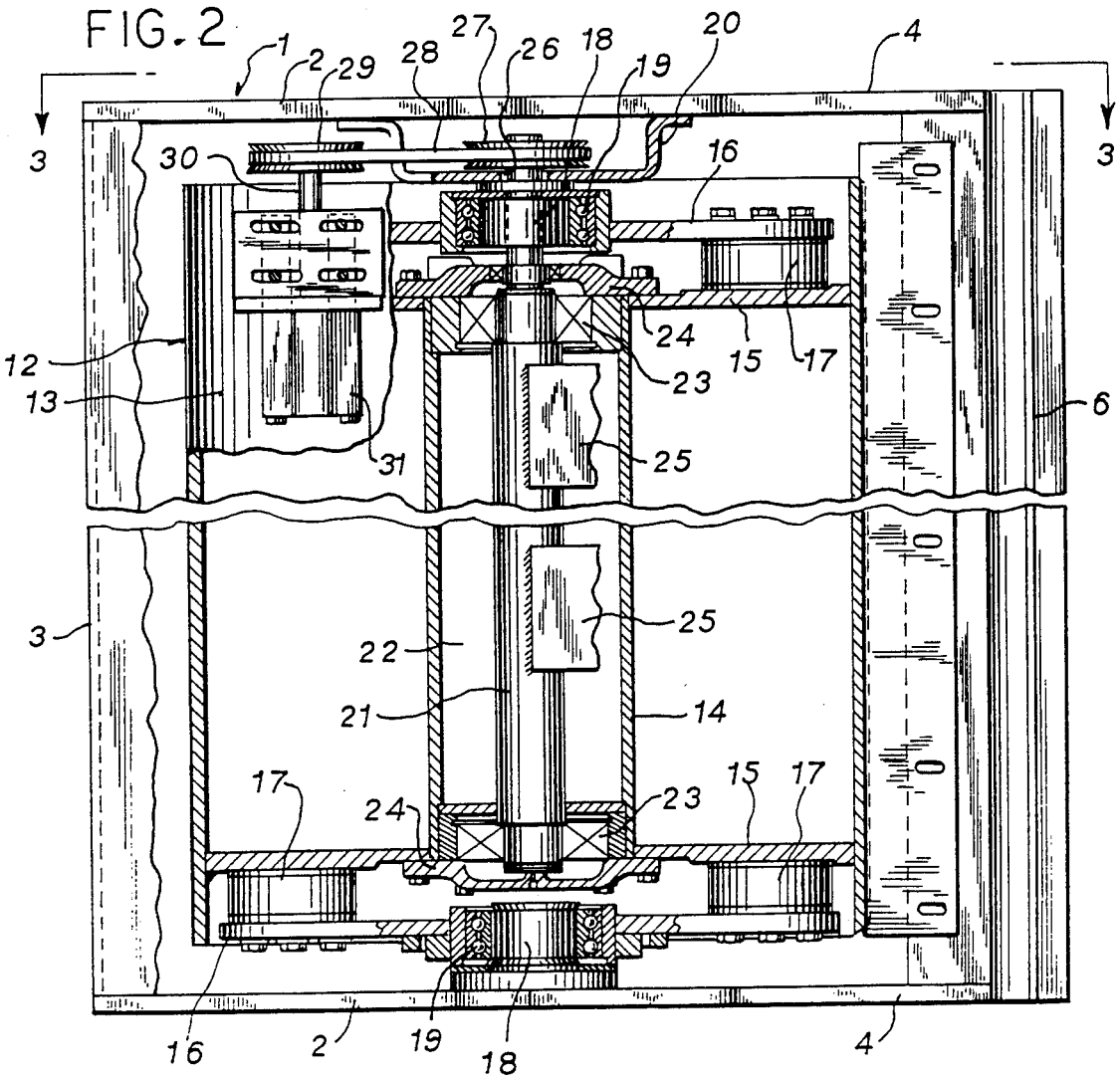

1
29
11
13
12
2
3
28
4
21
9
27
20
5
15
6

1
29
11
2
12
13
3
28
15
9
4
5
16
6

COMPACTOR AND BLADE ATTACHMENT FOR LOADER

BACKGROUND OF THE INVENTION

Small, front-end loaders are frequently used for small excavation cr grading operations. The typical loader includes a bucket terminating in a blade. The bucket is connected to the loader through a pair of lift arms, which are connected to the lower portion of the bucket, and a pair of tilt arms that are connected to the upper portion of the tucket. Through operation of the lift arms, the bucket can be raised and lowered, while operation of the tilt arms tends to tilt the bucket about the axis of the pivotal connection of the lift arms to the bucket to thereby either dump the bucket or move the blade downwardly in a position where the blade can engage the terrain for scraping operations.

After the terrain has been built up or leveled to the desire grade, it is often necessary to compact the soil through use of a separate, power-operated compactor. During compaction, the grade may change due to compaction of the soil, thereby requiring additional blade scraping to emitter fill the low areas or cut the high areas. Because of this, the contractor is required to use two separate and expensive pieces of equipment to accomplish the grading operation.

There has been a need for an inexpensive attachment for a front-end loader that can be selectively used for both grading and compaction, without the need of attaching or removing accessories.

SUMMARY OF THE INVENTION

The invention is directed to a compactor and blade attachment for a loader. In accordance with the invention, the attachment comprises a frame and a compaction drum journalled for rotation on the side plates of the frame. A scraping blade is secured to the forward ends of the side plates and is located ahead of the drum in the direction of movement of the loader.

The lift arms of the loader are pivotally connected to the lower end of the frame, while the tilt arms of the loader are pivoted to the upper portion of the frame. Through operation of the tilt arms, the frame can be pivoted around the pivotal connection of the lift arms to the frame to selectively move the blade from an inoperative position above the level of the lower extremity of the drum, to an operative position where the blade extends beneath the lower extremity of the drum. With the blade in the upper inoperative position, the compaction drum will ride on the terrain for a compacting operation. By tilting the blade to the operative position, the blade will engage the terrain for scraping or cutting of the soil.

As a feature of the invention, a vibratory mechanism can be connected to the drum to vibrate the drum and aid in the compaction. In a preferred form of the invention, the vibratory mechanism includes a shaft axially mounted for free rotation within the drum and the shaft carries a plurality of eccentric weights. A power source, such as a hydraulic motor, is carried by the drum and is operably connected to the shaft. Rotation of the shaft provides a vibratory motion for the drum. Resilient isolation mounts can interconnect the drum and the frame to isolate the vibrations from the frame.

Through operation of the tilt arms, the blade can be moved between an upper, inoperative position and a lower, operative or scraping position. Thus, through use of the attachment, the loader can be selectively used for either compaction or scraping operations, without the necessity of removing or attaching accessories or auxiliary equipment.

As a further advantage, the movement of the blade between the operative and inoperative positions is accomplished through normal operation of the lift arms of the loader and no additional power equipment is required to accomplish this motion.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of the attachment of the invention with the blade shown in an upper position;

FIG. 2 is a top plan view of the attachment;

DESCRIPTION OF THE ILLUSTRATED EMBODIMENT

Figure 3:
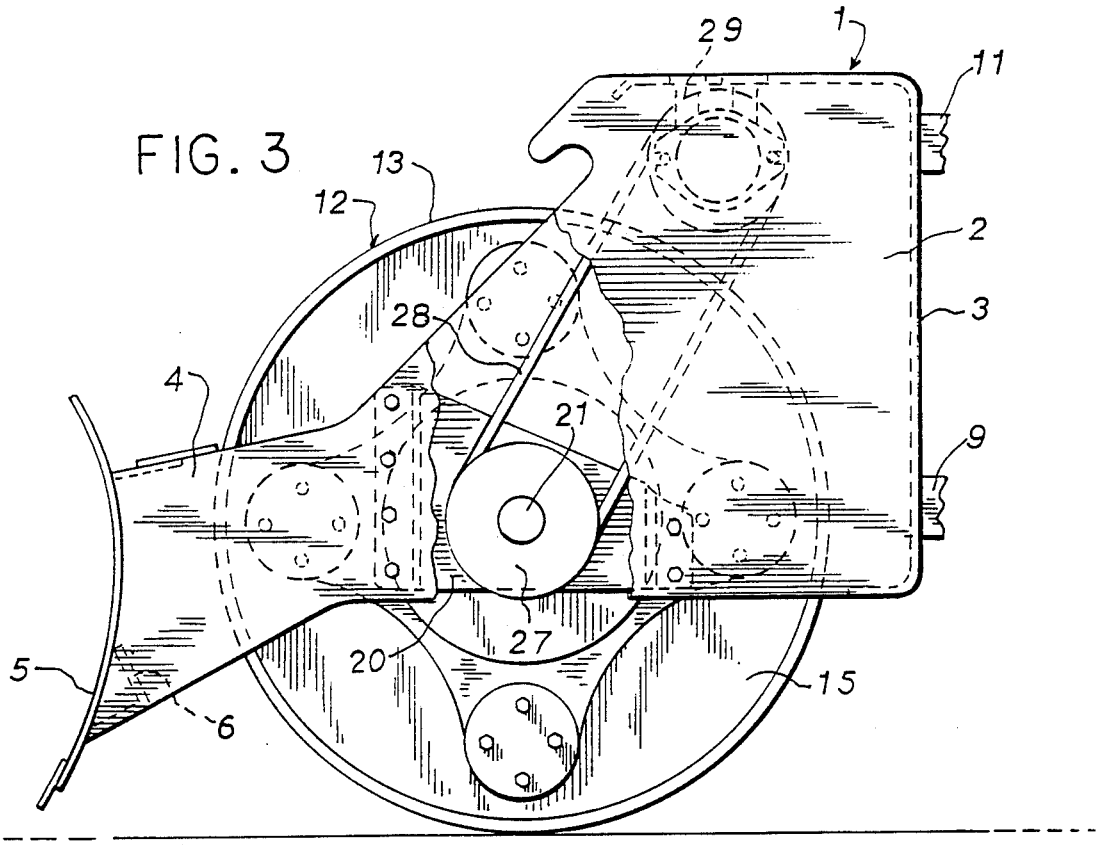
FIG. 3 is an end view taken along line 3/3 of FIG. 2.
Figure 4:
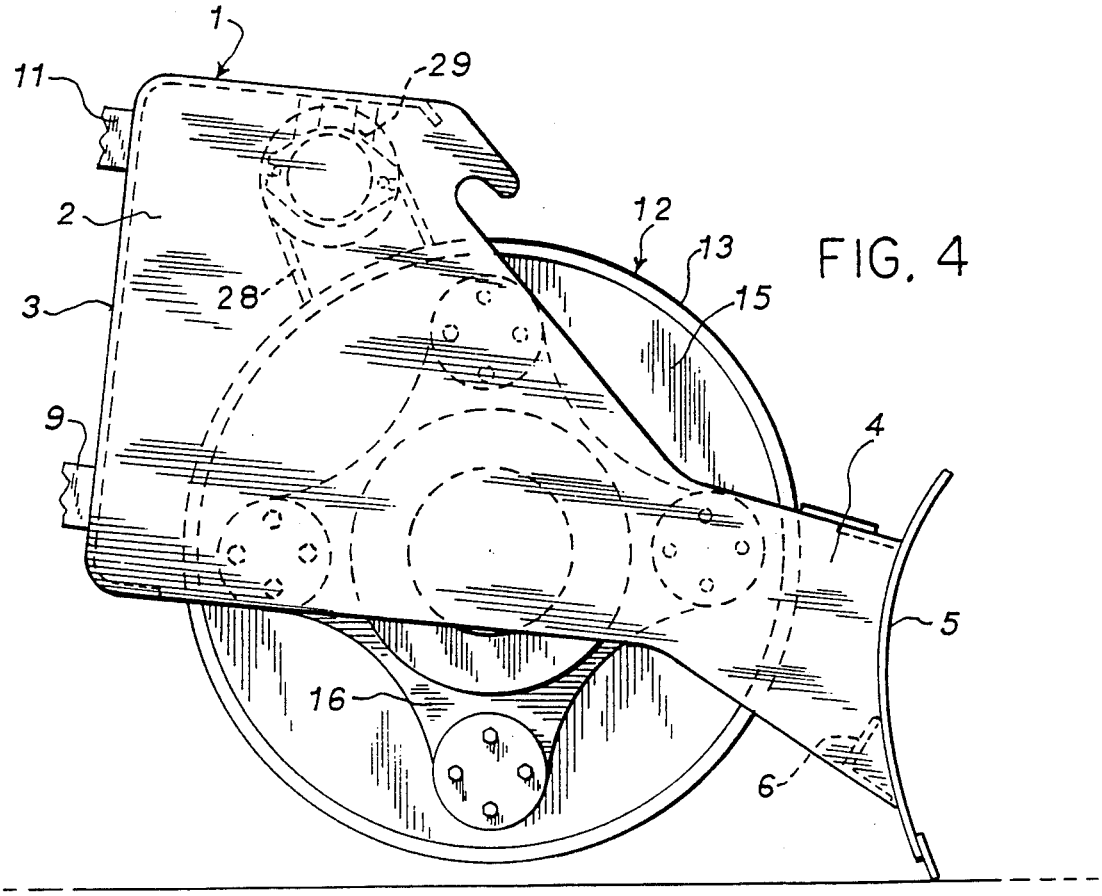
FIG. 4 is a view similar to FIG. 1 and showing the blade in a lower scraping position.

The drawings illustrate a compactor and blade attachment for a front-end loader. The attachment comprises a frame 1 composed of a pair of vertical spaced side plates 2, which are connected by a rear plate 3. As best shown in FIG. 1, plate 3 has a channel shape and is welded to the top edges as well as the rear edges and a portion of the bottom edges of the side plates.

The forward portion of side plates 2 in the direction of movement of the loader are provided with extensions 4 and a scraping blade 5 is secured to extensions 4 and extends transversely of frame 1. Blade 5 can be reinforced by an angle 6 which is secured to the rear surface of the blade and extends between side plates 2.

The frame 1 is supported and moved through connection to the standard arms of the front-end loader.

In this regard a pair of lift arms 8 are pivotally connected to lugs 9, which extend rearwardly from the lower portion of rear plate 3 of frame 1. A pair of tilt arms 10 of the loader are pivotally attached to lugs 11 that extend rearwardly from plate 3 and are located at the upper end of the frame.

Mounted for rotation in frame 1 is a compaction drum or roller 12. As best shown in FIG. 2, drum 12 includes an outer cylindrical shell 13 and an inner cylindrical shell 14 which is spaced inwardly of shell 13. The corresponding ends of shells 13 and 14 are connected by end plates 15.

To mount drum 12 for rotation, each end plate 15 is connected to a plate 16 through a plurality of resilient isolation mounts 17. The isolation mounts 17 are a standard type, being formed of a material such as rubber, and serve to minimize the transmission of vibrations from drum 12 to the supporting plates 16.

Each support plate 16 is journalled about a stub shaft 18 through a bearing assembly 19. One shaft 18 is secured to the respective side plate 2 of frame 1, while the shaft 18 at the opposite end of the frame is connected to a channel bracket 20 which in turn is bolted to the inner surface of the respective side plate 2, as illustrated in FIG. 2. With this construction the support plates 16 as well as drum 12 are mounted for rotation relative to frame 1.

Lift arms 8 operate in a conventional manner to raise and lower frame 1, thus moving the compaction drum into contact and out of contact with the soil or terrain. Movement of the tilt arms will act to tilt the frame 1 about the pivotal connection of arms 8 with lugs 9, thus moving the blade 5 to an upper inoperative position where the lower end of the blade is located at a level above the lower extremity of drum 12, as illustrated in FIG. 1. Through operation of the tilt arms 10, the frame 1 can be pivoted clockwise, as shown in FIG. 1, thus moving the blade 5 to an operative position where the lower extremity of the blade is beneath the level of the drum. In this position, the blade can provide a scraping operation on the terrain during loader travel. Thus, the blade can be moved between the inoperative and operative positions merely by the tilting of frame 1.

As a feature of the invention, a vibratory mechanism can be associated with the drum to vibrate the drum and aid in compaction. In this regard, a shaft 21 is spaced inwardly of the central passage 22 of drum 12. The ends of the shaft are journalled within bearing assemblies 23, which are mounted through bearing caps 24 to the end plates 15 of the drum. Shaft 21 carries one or more eccentric weights 25.

As shown in FIG. 2, one end of shaft 21 projects through an opening in bearing 19 as well as through an aligned opening 26 in bracket 20. The projecting end of the shaft carries a pulley 27. Pulley 27 is located within the channel bracket 20 and the pulley 27 is connected via a belt 28 to a pulley 29 mounted on the drive shaft 30 of a motor 31, preferably a hydraulic motor. As shown in FIG. 2, motor 31 is located within the drum and is mounted on the inner surface of one of the end plates 15. Through operation of motor 31, shaft 21 will be rotated and vibrations will be imparted to drum 12 to aid in the compaction operation. The isolation mounts 17 act to minimize the transmission of the vibrations from drum 12 to frame 1 and consequently to the loader.

The invention provides a simple and inexpensive attachment for a front-end loader which combines both the compaction and scraping functions. The two functions can be selectively used through tilting of frame 1. No auxiliary power equipment is required to change from the compacting mode to the scraping mode.

Various modes of carrying out the invention are contemplated as being within the scope of the following claims particularly pointing out and distinctly claiming the subject matter which is regarded as the invention.

I claim:

1. An attachment for a front-end loader having lift arm means and tilt arm means, said attachment comprising a frame including a pair of side plates, first connecting means for pivotally connecting the lift arm means of the loader to said frame about a first pivot axis, second connecting means for pivotally connecting the tilt arm means of the loader to said frame at a second pivot axis spaced from said first pivot axis, a compaction drum mounted for free rotation about a horizontal drum axis with respect to said frame and disposed to move over the terrain in a fore and aft direction normal to the drum axis, a scraping blade fixed to said frame said first and second connecting means being disposed on one side of a vertical plane extending along said drum axis and said scraper blade being disposed on a side opposite said one side of said vertical plane, said tilt arm means being constructed and arranged to tilt said frame about said first pivot axis to thereby move the lower edge of said blade from an inoperative position where said lower edge is above the level of the lower extremity of said drum to an operative position where said lower edge is disposed beneath the level of said lower extremity of said drum, vibratory means operably connected to said drum, drive means mounted on the drum and operably connected to said vibratory means for operating said vibratory means to vibrate said drum, an end plate disposed between each end of the drum and the corresponding side plates, journalling means for journaling each end plate for rotation relative to the corresponding side plate, and resilient isolation mount means interconnecting each end plate and the corresponding end of said drum.

2. The combination of claim 1, wherein said vibratory means includes a shaft disposed concentrically of said drum and mounted for rotation relative to said drum, and eccentric weight means mounted on the shaft.

3. The combination of claim 2, wherein said drive means includes a motor disposed within the drum.

4. The combination of claim 2, wherein an end of said shaft is disposed concentrically of said journalling means and extends outwardly of one of said end plates, said drive means being connected to said end of the shaft and located on the outside of said one end plate.

* * * * *